United States Patent [19]

Weber

[11] 4,000,587

[45] Jan. 4, 1977

[54] GUTTER STRUCTURE

[76] Inventor: William H. Weber, 8182 Clifton Court, Mentor, Ohio 44060

[22] Filed: Feb. 5, 1975

[21] Appl. No.: 547,121

[52] U.S. Cl. ..... 52/16; 248/48.1

[51] Int. Cl.[2] ..... E04D 13/06

[58] Field of Search ..... 52/16, 11–15, 52/60, 94, 96; 248/48.1, 48.2

[56] References Cited

UNITED STATES PATENTS

| | | | |
|---|---|---|---|
| 803,316 | 10/1905 | Vogel | 52/16 |
| 1,762,756 | 6/1930 | Braunstein | 52/11 |
| 2,725,832 | 12/1955 | Huntington | 52/96 |
| 3,271,913 | 9/1966 | Fields | 52/16 |
| 3,426,488 | 2/1969 | Stanford | 52/15 |
| 3,611,649 | 10/1971 | Muller | 52/14 |
| 3,809,347 | 5/1974 | Pekark | 248/48.1 |
| 3,826,048 | 7/1974 | Merkin | 52/11 |

FOREIGN PATENTS OR APPLICATIONS

| | | | |
|---|---|---|---|
| 677,810 | 1/1964 | Canada | 52/16 |
| 82,857 | 5/1957 | Denmark | 52/60 |
| 106,739 | 12/1899 | Germany | 52/94 |
| 644,253 | 10/1950 | United Kingdom | 52/94 |

*Primary Examiner*—John E. Murtagh
*Attorney, Agent, or Firm*—McNenny, Pearne, Gordon, Gail, Dickinson & Schiller

[57] ABSTRACT

A building structure is disclosed having a facia board 13 and a shingled roof 14. A gutter assembly is secured to the facia board 13 and includes a gutter member 18 and a roof plate 19. The roof plate 19 includes an open C-shaped cavity 30 which receives a flange 25 projecting from the gutter member. The free edge 26 of the flange resiliently seals against the portion of the gutter member which defines the cavity to prevent water from seeping under the roof plate by capillary action. The vertical disposition of the flange in the cavity varies along the axial length of the cavity for pitching the gutter member. The rear wall 21 of the gutter member is nailed to the facia board, and the front wall 22 of the gutter member is supported by a support bracket 37 extending from the rear wall to the front wall.

11 Claims, 4 Drawing Figures

GUTTER STRUCTURE

BACKGROUND AND SUMMARY OF THE INVENTION

Gutter assemblies are generally provided on building structures with sloping roofs to receive and carry the water which runs off the roof. A roof plate is also frequently provided which extends from the gutter member upwardly along the roof between the shingles and the roof substrate. The roof plate prevents water from contacting the substrate in the event water seeps upwardly under the shingles by capillary action.

Various types of such prior art gutter assemblies having gutter members and roof plates are disclosed in U.S. Pat. Nos. 667,821, 873,407, 929,684, 2,943,421, 3,426,488, 3,248,827, and 3,436,877.

The present invention departs from these prior art gutter assemblies by providing a pitchable gutter assembly which includes a roof plate defining a C-shaped pitching cavity and a gutter member which includes a pitching flange extending into the cavity. The vertical disposition of the flange in the cavity varies along the axial length of the cavity for pitching the gutter member, and the free edge of the flange resiliently seals against one of the cavity walls for preventing water from seeping under the roof plate by capillary action.

More specifically, the roof plate includes a roof wall adapted to be secured to the shingled roof underneath the shingles. The roof wall extends over the gutter member and terminates at a connecting wall which extends vertically downwardly into the gutter member vertically below the top marginal edges of the gutter member. The connecting wall terminates at a cavity flange which is reversely bent and which extends back in a direction toward the facia board preferably parallel to the roof wall. In this manner, the roof wall and connecting wall and cavity flange define an open C-shaped pitching cavity which faces in a direction toward the facia board.

The gutter member includes a back wall and a front wall and a bottom wall which define an open generally U-shaped water cavity for receiving run-off water from the shingled roof. The back wall at its upper end adjacent the roof plate has a pitching flange which extends into the pitching cavity of the roof plate. At the higher end of the gutter member this pitching flange is toward the top of the pitching cavity, and at the lower end of the gutter member this pitching flange is disposed vertically lower in the pitching cavity. This accommodates the proper pitch for the gutter member to insure water flow along the gutter member in a direction toward the downspout. The free edge of the pitching flange resiliently engages one of the cavity walls for preventing water from seeping under the roof plate.

BRIEF DESCRIPTION OF THE DRAWINGS

These and other features and advantages of the present invention are incorporated in the presently preferred embodiment of the invention shown in the drawings, wherein.

DETAILED DESCRIPTION OF THE DRAWINGS

Figure 1:
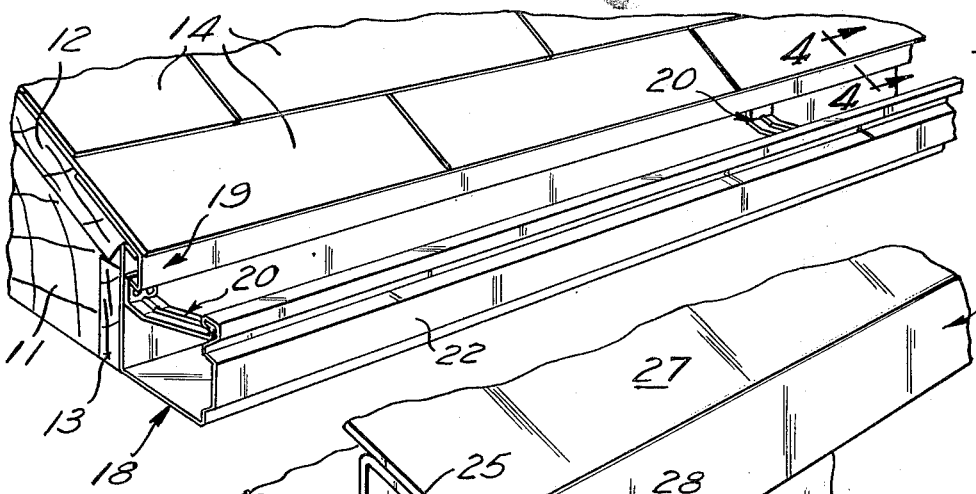
FIG. 1 is a perspective view of a building structure having a gutter assembly according to the principles of the invention, omitting an end plate normally supplied at the end of the gutter member.

Referring now to the drawings in greater detail, FIG. 1 shows a portion of a building structure which includes a rafter 11, a plywood roof substrate board 12, a facia board 13, and a plurality of conventional asphalt shingles 14.

The building structure shown in FIG. 1 also includes a gutter assembly which includes a gutter member 18, a roof plate 19, and attachment means 20. The gutter member 18 and roof plate 19 are preferably roll formed from suitable aluminum sheet stock, and the support bracket described in greater detail below of the attachment means 20 is preferably stamped from a suitable aluminum bar stock. Alternatively, these structures could be made of any other suitable material such as galvanized steel stock.

Figure 2:
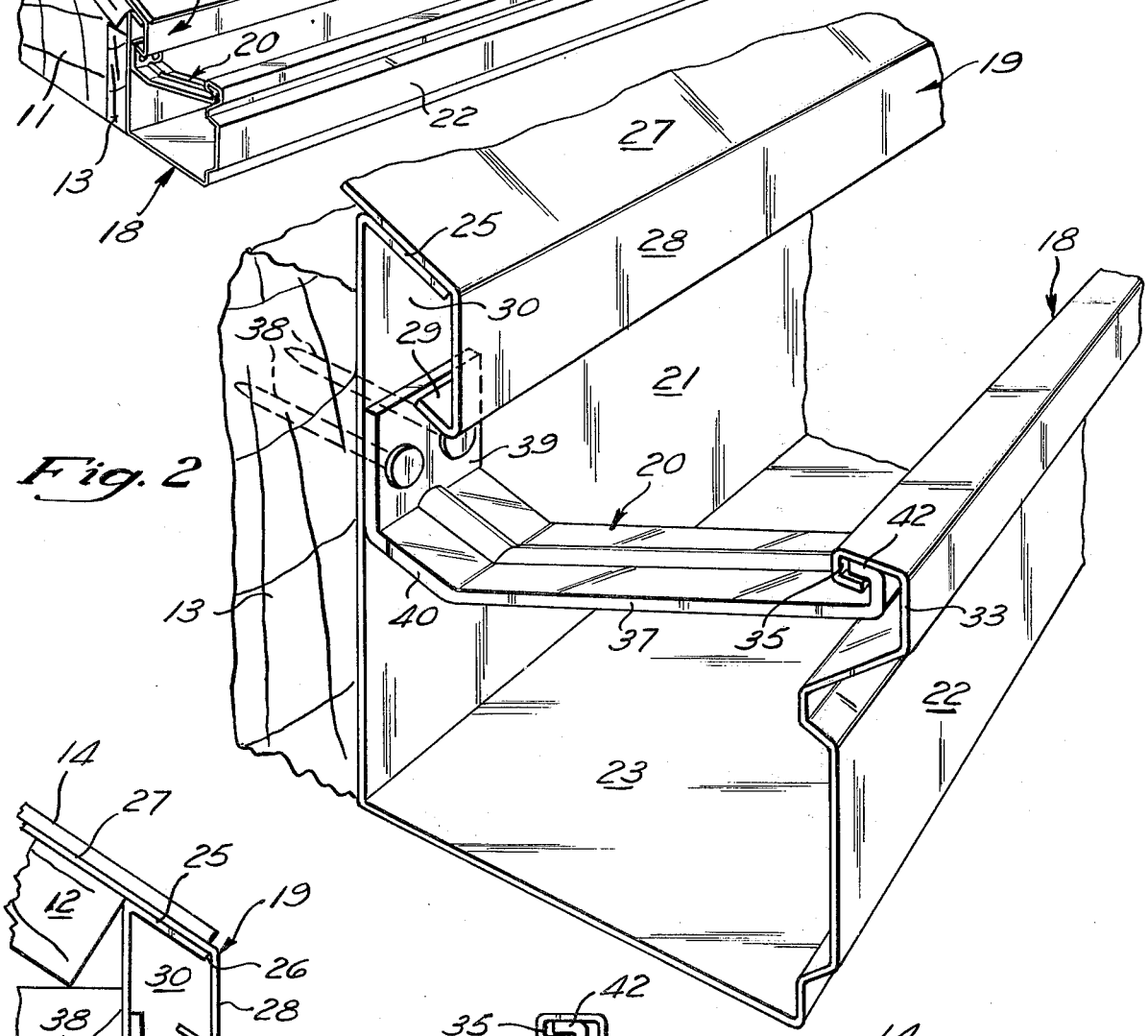
FIG. 2 is an enlarged perspective view of the structure shown in FIG. 1.
Figure 3:
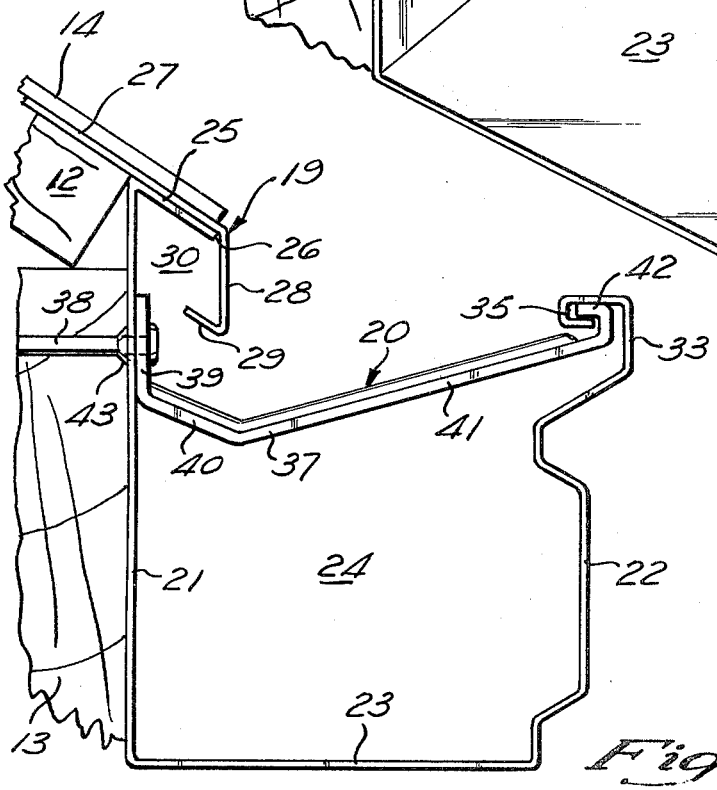
FIG. 3 is an enlarged end view of the structure shown in FIG. 1.

The gutter member 18 and roof plate 19 are of predetermined uniform lateral cross-sectional configuration along their entire axial extent, and the structural details of the gutter member 18 and roof plate 19 and attachment means 20 are shown in FIGS. 2 and 3. The gutter member 18 includes a generally vertically extending back wall 21, a generally vertically extending front wall 22, and a generally horizontally extending bottom wall 23. In the preferred embodiment, the backwall 21 extends vertically about 5¾ inches, the front wall 22 extends vertically about 4¾ inches, and the bottom wall 23 extends horizontally about 4½ inches. The walls 21, 22, and 23 define an axially extending open water cavity 24 for receiving run-off water from the shingles 14 of the building structure. The upper free end of the back wall 21 terminates at a pitching flange 25 which extends a predetermined distance in a direction away from the back wall 21 toward the front wall 22. In the preferred embodiment, this predetermined distance is one inch and the angle at which the pitching flange 25 extends from the back wall 21 is equal to the angular slope of the roof of the building structure, the angle defined by the flange 25 and the facia board or back wall 21 being less than 90°.

The roof plate 19 includes a roof wall 27 which extends along the roof of the building structure between the substrate 12 and the shingles 14 to prevent water which might seep upwardly beneath the shingles 14 by capillary action from engaging the substrate 12 and to direct such water downwardly toward the gutter 18. The roof plate 19 is secured to the substrate 12 by any suitable means, such as nails (not shown) which extend beneath the shingles 14 through the roof wall 27 into the substrate 12. The roof wall 27 extends past the end of the substrate 12 and over the pitching flange 25 of the gutter member 18, and the lowermost end of the roof wall 27 extends to a connecting wall 28. The connecting wall 28 extends generally vertically downwardly into the gutter member 18 a predetermined distance of about two inches to a cavity flange 29. The cavity flange 29 extends from the connecting wall 28 a predetermined distance in a direction toward the back wall 21. In the preferred embodiment shown in the drawings, this predetermined distance is no greater than one half the extent of the pitching flange 25, and the angle at which the cavity flange 29 extends from the connecting wall 28 is equal to the angular slope of the roof of the building structure. As discussed in greater detail below, the roof plate 27 and connecting wall 28 and cavity flange 29 define a generally C-shaped pitching cavity 30 which faces in a direction toward the back wall 21 for receiving the pitching flange 25. The free marginal edge 26 of the pitching flange 25 abuts the vertically depending connecting wall 28 with a resilient force provided by pushing the roof plate connecting wall 28 tightly against the free edge 26 of the flange 25 (FIG. 4) upon installation to slightly resiliently deform the connecting wall 28 or the flange 25 or both. This not only seals against water seepage under the roof wall 27 by capillary action or by melting snow or ice piled in the gutter, but also assures proper spacing of the roof plate 27 relative to the gutter member 18 and the roof line.

The front wall 22 includes a generally vertically extending drip wall 33 which is disposed laterally outwardly beyond the remaining portions of the front wall 22 and which is connected to the lower portions of the front wall 22 by a portion of convex configuration when viewed from the interior of the water cavity 24. This configuration insures that any water overflowing the top of the front wall 22 (such as when the water cavity 24 overflows when the downspout not shown is clogged or during an exceptionally heavy rain) will drip off of the bottom of the drip wall 33 down to the ground and will not flow downwardly along the portions of the wall 22 below the drip wall 33 and from there along the bottom wall 23 to the facia board 13. The top free end of the front wall 22 is bent in a generally C-shaped configuration facing in a direction away from the rear wall 21 to define an open cavity 35 for cooperating with the attachment means 20 in the manner described below.

As further shown in FIGS. 2 and 3, the attachment means 20 secures the gutter member 18 to the facia board 13. Each attachment means 20 includes a support bracket 37 and a pair of nails 38 which extend through suitable holes in the support bracket 37 and through the back wall 21 of the gutter member 18. As shown in the drawings, the heads of the nails 38 are disposed adjacent the holes in the support bracket 37 and the back wall 21. The support bracket 37 includes a nail flange 39, a downwardly extending portion 40 which extends downwardly in a direction toward the bottom wall 23 and forwardly in a direction toward the front wall 22, an upwardly extending portion 41 which extends upwardly away from the bottom wall 23 and forwardly toward the front wall 22, and a lip 42 which extends in a direction toward the rear wall 21 for being received within the cavity 35. The rear wall 21 is provided with suitable indented portions 43 for defining the location of the nail flange 39 and nails 38 on the rear wall 21. Because the portion 40 of the support bracket 37 extends downwardly away from the nail flange 39, the support bracket 37 does not interfere with the connecting wall 28 or cavity wall 29 of the roof plate 19. The lip 42 of the support bracket 37 is received within the cavity 35 so that the support bracket 37 supports the front wall 22 and prevents vertically downward bending of the front wall 22 even when the gutter member 18 is filled with ice and icicles extend down from the drip wall 33 causing added weight on the front wall 22.

The gutter assembly shown in the drawings may be attached to the remaining portions of the building structure either before or after the shingles 14 are placed on the substrate 12. The gutter member 18 is first positioned on the facia board 13 with a slight fall or pitch from the left to the right as viewed in FIG. 1 so that the left end of the gutter member 18 is slightly higher than the right end of the gutter member 18. The right end of the gutter member 18 is provided with a suitable downspout (not shown) for carrying water from the cavity 24 down to the ground. The support bracket 37 is installed with the lip 42 extending into the cavity 35, and the nails 38 are driven through the rear wall 21 and into the facia board 13. After the gutter member 18 is installed, the roof plate 19 is positioned with its roof wall 27 on the substrate 12 in the manner shown in the drawings. If the shingles 14 are installed prior to installation of the roof plate 19, the lower row of shingles is simply lifted up for such installation of the roof plate 19.

Figure 4:
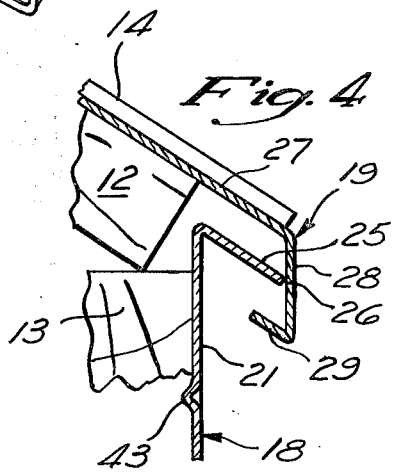
FIG. 4 is an enlarged side elevational view taken along reference view line 4—4 in FIG. 1.

Because the cavity flange 29 of the roof plate 19 is spaced well below the roof wall 27, space is allowed in the pitching cavity 30 so that the vertical disposition of the pitching flange 25 of the gutter member 18 varies along the axial length of the gutter member 18 for pitching the gutter member. This variation in the vertical disposition of the pitching flange 25 is best seen in FIG. 4, wherein the pitching flange 25 at a location far removed from the left end of the gutter member 18 shown in FIG. 3 is spaced vertically downwardly from its position at the left end shown in FIG. 3. As also seen in FIG. 4, the resilient abutting engagement of the pitching flange edge 26 and connecting wall 28 prevents water from seeping back under the roof wall 27 or behind the back wall 21 at locations where the pitching flange 25 is spaced vertically downwardly from the roof wall 27. The cavity flange 29 of the roof plate 19 provides a guide or stop to positively limit the lowermost position of the pitching flange 25 of the gutter member 18 and to insure that the pitch of the gutter member 18 is proper and not excessive.

Although a presently preferred embodiment of the invention is shown and described herein, various modifications and rearrangements may be made without departing from the scope of the invention as defined by the following claims.

What is claimed is:

1. A gutter assembly comprising a gutter member and a roof plate, and a building structure having a roof board and a facia board; said roof board being a part of a roof of said building and having a predetermined angular slope relative to said facia board; said gutter member including a generally vertically extending back wall and a generally vertically extending front wall and a generally horizontally extending bottom wall, said back wall and front wall and bottom wall defining an open cavity adapted to receive run off water from said roof, said back wall being secured to said facia board and said back wall having at its upper end a pitching flange extending a predetermined distance in a direction toward said front wall; said roof plate including a generally flat one-piece roof wall secured to said roof board and extending laterally in a straight line parallel to said slope of said roof board over said roof board and beyond said facia board and beyond said back wall of said gutter member and beyond said gutter member pitching flange, said roof wall terminating at an edge over said bottom wall, a connecting wall extending generally vertically downwardly from said termination edge of said roof wall a predetermined distance in a direction toward said gutter member bottom wall, said connecting wall terminating at an edge over said gutter member bottom wall, and a cavity flange extending a predetermined distance from said termination edge of said connecting wall in a direction toward said back wall, said roof wall and connecting wall and cavity flange defining an open pitching cavity; said pitching cavity receiving said gutter member pitching flange, said gutter member pitching flange being adjacent said roof plate roof wall at one end of said gutter member, and the vertical disposition of said gutter member pitching flange in said pitching cavity varying along the axial length of said gutter member for pitching said gutter member.

2. A gutter assembly as set forth in claim 1 including a plurality of shingles covering said roof board and covering said roof wall of said roof plate, said shingles extending in a straight line parallel to said slope of said roof board beyond said roof board and beyond said facia board and beyond said back wall of said gutter member over said bottom wall of said gutter member, and said roof wall providing vertical support for the portion of said shingles which extends beyond said roof board over said bottom wall of said gutter member.

3. A gutter assembly as set forth in claim 1 wherein said pitching cavity faces in a direction toward said back wall, and the extent of said cavity flange is no greater than one-half the extent of said pitching flange.

4. A gutter assembly as set forth in claim 3 wherein said cavity flange extends from said connecting wall at an angle equal to the angular slope of said roof.

5. A gutter assembly as set forth in claim 1 including a downspout disposed at one end of said gutter member, and said pitching flange is disposed vertically lower in said pitching cavity at said one end near said downspout and vertically higher in said pitching cavity at the other end of said gutter member away from said downspout.

6. A gutter assembly as defined in claim 1 wherein said pitching flange terminates at a free marginal edge, and said free marginal edge abuts said connecting wall for preventing water leakage therebetween.

7. A gutter assembly as defined in claim 6 wherein said free marginal edge resiliently engages said connecting wall.

8. A gutter assembly comprising a gutter member a roof plate, attachment means, and a building structure having a roof board and a facia board; said roof board being a part of a roof of said building and having a predetermined angular slope relative to said facia board; said gutter member including a generally vertically extending back wall and a generally vertically extending front wall and a generally horizontally extending bottom wall, said back wall and front wall and bottom wall defining an open cavity adapted to receive run off water from said roof, said back wall being secured to said facia board and said back wall having at its upper end a pitching flange extending a predetermined distance in a direction toward said front wall; said roof plate including a generally flat one-piece roof wall secured to said roof board and extending laterally in a straight line parallel to said slope of said roof board over said roof board and beyond said facia board and beyond said back wall of said gutter member and beyond said gutter member pitching flange, said roof wall terminating at an edge over said bottom wall, a connecting wall extending generally vertically downwardly from said termination edge of said roof wall a predetermined distance in a direction toward said gutter member bottom wall, said connecting wall terminating at an edge over said gutter member bottom wall, and a cavity flange extending a predetermined distance from said termination edge of said connecting wall in a direction toward said back wall, said roof wall and connecting wall and cavity flange defining an open pitching cavity; said pitching cavity receiving said gutter member pitching flange, said gutter member pitching flange being adjacent said roof plate roof wall at one end of said gutter member, and the vertical disposition of said gutter member pitching flange in said pitching cavity varying along the axial length of said gutter member for pitching said gutter member; and said attachment means securing said back wall and said front wall of said gutter member to said facia board, said attachment means including a plurality of identical support brackets spaced along said axial length of said gutter member and at least one nail associated with each support bracket, said identical support brackets each extending from said back wall to said front wall for supporting said front wall, said identical support brackets each being identically positioned relative to said gutter member, said successive ones of said support brackets being disposed successively farther away from said roof plate, said nails each extending through its associated support bracket and through said back wall and into said facia board, and said attachment means being constructed and arranged to support said gutter member completely independently of said roof plate with said support brackets and nails each being spaced away from said roof plate whereby said pitching of said gutter member does not interfere with the structure and operation of said attachment means.

9. A gutter assembly comprising a gutter member and a roof plate and attachment means; said gutter member including a generally vertically extending back wall and a generally vertically extending front wall and a generally horizontally extending bottom wall, said back wall and front wall and bottom wall defining an open cavity adapted to receive run off water from a roof, said back wall being adapted to be secured to a facia board and said back wall having at its upper end a pitching flange extending a predetermined distance in a direction toward said front wall; said roof plate including a roof wall adapted to be secured to a roof and extending over said gutter member pitching flange, a connecting wall extending generally vertically downwardly a predetermined distance from said roof wall in a direction toward said gutter member bottom wall, and a cavity flange extending a predetermined distance from said connecting wall in a direction toward said back wall, said roof wall and connecting wall and cavity flange defining an open pitching cavity; said pitching cavity receiving said gutter member pitching flange, the vertical disposition of said gutter member pitching flange in said pitching cavity varying along the axial length of said gutter member for pitching said gutter member; said attachment means being adapted to secure said back wall to a facia board, said attachment means including a support bracket extending from said back wall to said front wall for supporting said front wall against vertically downward bending, said attachment means includes at least one nail adapted to extend through said back wall and into a facia board, said support bracket includes a nail flange adjacent said back wall through which said nail projects, said nail including a head disposed adjacent said nail flange, said support bracket is of one piece construction and includes one portion extending away from said nail flange in a direction vertically downwardly toward said bottom wall and laterally forwardly toward said front wall, and another portion extending away from said one portion in a direction vertically upwardly away from said bottom wall and laterally forwardly toward said front wall, and said other portion being secured to said front wall.

10. A gutter assembly comprising a gutter member and a roof plate; said gutter member including a generally vertically extending back wall and a generally vertically extending front wall and a generally horizontally extending bottom wall, said back wall and front wall and bottom wall defining an open cavity adapted to receive run off water from a roof, said back wall being adapted to be secured to a facia board and said back wall having at its upper end a flange extending a predetermined distance in a direction toward said front wall and terminating at a free edge; said roof plate including a generally flat one piece roof wall adapted to be secured to a roof and extending laterally in a straight line parallel to the slope of said roof over said roof and beyond said facia board and beyond said back wall of said gutter member and beyond said gutter member flange, said roof wall terminating at an edge over said bottom wall, a connecting wall extending generally vertically downwardly from said termination edge of said roof wall a predetermined distance in a direction toward said gutter member bottom wall, said connecting wall terminating at an edge over said gutter member bottom wall, and a cavity wall extending a predetermined distance from said termination edge of said connecting wall in a direction toward said back wall, said roof wall and connecting wall and cavity wall defining an open cavity; said cavity receiving said gutter member flange, the vertical disposition of said gutter member flange in said open cavity varying along the axial length of said gutter member for pitching said gutter member, and said gutter member free edge resiliently engaging said connecting wall along its entire axial extent for preventing water leakage therebetween.

11. A gutter assembly comprising a gutter member and attachment means; said gutter member including a generally vertically extending back wall and a generally vertically extending front wall and a generally horizontally extending bottom wall, said back wall and front wall and bottom wall defining an open cavity adapted to receive run off water from a roof; said attachment means including a support bracket extending from said back wall to said front wall for supporting said front wall against vertically downwardly bending and at least one nail extending through said back wall, said support bracket including a nail flange adjacent said back wall through which said nail projects, said nail including a head disposed adjacent said nail flange, said support bracket is of one piece construction and includes one portion extending away from said nail flange in a direction vertically downwardly toward said bottom wall and laterally forwardly toward said front wall, and another portion extending away from said one portion in a direction vertically upwardly away from said bottom wall and laterally forwardly toward said front wall, and said other portion being secured to said front wall.

* * * * *